US011408688B2

(12) United States Patent
Kent

(10) Patent No.: US 11,408,688 B2
(45) Date of Patent: Aug. 9, 2022

(54) HEAT EXCHANGER

(71) Applicant: MAHLE International GmbH, Stuttgart (DE)

(72) Inventor: Scott Edward Kent, Albion, NY (US)

(73) Assignee: MAHLE International GmbH, Stuttgart (DE)

( * ) Notice: Subject to any disclaimer, the term of this patent is extended or adjusted under 35 U.S.C. 154(b) by 239 days.

(21) Appl. No.: 16/903,526

(22) Filed: Jun. 17, 2020

(65) Prior Publication Data

US 2021/0396481 A1 Dec. 23, 2021

(51) Int. Cl.
*F28F 9/02* (2006.01)

(52) U.S. Cl.
CPC ..... *F28F 9/0275* (2013.01)

(58) Field of Classification Search
CPC ..... F28F 9/0275; F28F 9/0273; F28F 9/028; F28F 9/0282; F28F 9/013
USPC ..... 165/164
See application file for complete search history.

(56) References Cited

U.S. PATENT DOCUMENTS 1,847,608 A * 3/1932 Harnett ..... F28D 1/0535 165/174
5,172,759 A * 12/1992 Shimoya ..... F28F 13/08 165/110
6,814,136 B2 * 11/2004 Yi ..... F28F 9/026 165/174
7,921,558 B2 * 4/2011 Beamer ..... F28F 9/0273 165/174
8,034,308 B2 * 10/2011 Chiu ..... F28F 9/0202 165/172
8,113,270 B2 * 2/2012 Rios ..... F28F 9/0273 29/890.035
8,281,615 B2 * 10/2012 Tucker ..... F25B 39/028 62/515
9,989,283 B2 * 6/2018 Alahyari ..... F25B 39/00
10,082,341 B2 * 9/2018 Brunhuber ..... F28D 20/0056
10,126,065 B2 * 11/2018 Pautler ..... F28F 9/0282
10,145,295 B2 * 12/2018 Berger ..... F02B 29/0462
10,197,312 B2 * 2/2019 Xia ..... F25B 39/00
10,393,445 B2 * 8/2019 Takagi ..... F28F 9/001
2003/0010483 A1 * 1/2003 Ikezaki ..... F28F 9/0273 165/174
2003/0066636 A1 * 4/2003 Kawakubo ..... F28D 7/0025 165/177
2008/0023185 A1 * 1/2008 Beamer ..... F28F 9/0246 165/174
2010/0242535 A1 * 9/2010 Jianlong ..... F25B 39/028 62/524

(Continued)

*Primary Examiner* — Jon T. Schermerhorn, Jr.
(74) *Attorney, Agent, or Firm* — Dickinson Wright PLLC

(57) ABSTRACT

A heat exchanger (1) includes a fluid collector (2) for receiving fluid, a multiphase distributor (3) for distributing fluid, a first flow path (4), and a plurality of multi-duct tubes (6), which each have a duct tube longitudinal axis (7) and which each lead into the multiphase distributor (3) and into the fluid collector (2) by forming an orifice (8, 9). A second flow path (5) leads respectively through the multi-duct tubes (6), the fluid collector (2), and the multiphase distributor (3), wherein the multi-duct tubes (6) extend through the first flow path (4) for the first fluid, so that the first fluid can flow around and the second fluid can flow through the multi-duct tubes (6).

9 Claims, 3 Drawing Sheets

(56) References Cited

U.S. PATENT DOCUMENTS

| | | | | |
|---|---|---|---|---|
| 2011/0174287 | A1* | 7/2011 | Cherington | F24H 3/087<br>126/58 |
| 2015/0136366 | A1* | 5/2015 | Fukui | F28F 13/06<br>165/148 |
| 2017/0219298 | A1* | 8/2017 | Tsutsui | F28D 1/0435 |
| 2018/0010857 | A1* | 1/2018 | Yang | F28F 9/0275 |
| 2018/0058763 | A1* | 3/2018 | Wei | F28D 7/1638 |
| 2018/0112897 | A1* | 4/2018 | Jindou | F28F 9/0275 |
| 2019/0207280 | A1* | 7/2019 | Kenney | B23P 15/26 |
| 2020/0309034 | A1* | 10/2020 | Thomas | F28F 9/0246 |

* cited by examiner

HEAT EXCHANGER

TECHNICAL FIELD

The invention relates to a heat exchanger for coupling a first fluid to a second fluid so as to transfer heat and in a fluidically separate manner, comprising a fluid collector for receiving fluid, comprising a multiphase distributor for distributing fluid, comprising a first flow path for the first fluid, and comprising a plurality of multi-duct tubes, which are aligned parallel to one another and which each have a duct tube longitudinal axis. The respective multi-duct tubes lead into the multiphase distributor by forming a distributor orifice and into the fluid collector by forming a collector orifice. A second flow path for the second fluid thereby respectively extends through the multi-duct tubes, the fluid collector, and the multiphase distributor, wherein the multi-duct tubes extend through the first flow path for the first fluid, so that the first fluid can flow around and the second fluid can flow through the multi-duct tubes, respectively.

BACKGROUND

Heat exchangers of this type have been known for a long time and serve the purpose of exchanging or of transferring, respectively, thermal energy between a first fluid and a second fluid. They may be used, for example, in air conditioning systems or cooling units, preferably in large-capacity air conditioning systems or large-capacity cooling units.

In spite of large development efforts, the known heat exchangers have an icing problem in the area of the multi-duct tubes of the heat exchanger, which effect the heat exchange between the first and second fluid. It is generally possible to operate the heat exchangers for heating as part of a heating operation or for cooling as part of a cooling operation. During the heating operation, for example, thermal and flow-related condensate formation occurs at the multi-duct tubes, around which the first fluid flows, and at or in the area between the multi-duct tubes and the multiphase distributor. Condensate, for example water, originating from the first fluid deposits for example on the outside of the multi-duct tubes. The condensate flows downwards along the multi-duct tubes due to gravity, where it constricts or impedes the first flow path for the first fluid, so that, in terms of mass flow or volume flow, less first fluid can flow through the heat exchanger along the first flow path. The flow speed of the first fluid, for example, is reduced. As has been recognized, however, the reduction of the mass flow or of the volume flow or of the flow speed of the first fluid necessitates a decrease of the temperature in the area of the multi-duct tubes, wherein the condensate at the multi-duct tubes freezes gradually. This results in a continually increasing icing of the heat exchanger culminating in the total icing. The energy efficiency of the heat exchanger is diminished thereby, even though there is already the wish for more energy-efficient technical solutions for environmental reasons.

SUMMARY

The basic idea of the invention lies in using the fluid collector and the multiphase distributor of a heat exchanger, compared to the previously known heat exchangers, basically in reversed installation positions.

For this purpose, it is provided that a heat exchanger for coupling a first fluid to a second fluid so as to transfer heat and in a fluidically separate manner, is equipped with at least one fluid collector, preferably with a hollow interior, for collecting, i.e. for receiving fluid, and with at least one multiphase distributor, preferably with a hollow interior, for distributing fluid, for example in a nozzle-like manner. It is possible that the fluid collector is suitable for distributing fluid, and the multiphase distributor for collecting fluid. In any event, the heat exchanger has or defines a first flow path for the first fluid, for example air or ambient air. The heat exchanger furthermore has a plurality of multi-duct tubes, which each have a duct tube longitudinal axis and which are aligned parallel or at an angle to one another, and which each lead into the multiphase distributor by forming a distributor orifice, and into the fluid collector by forming a collector orifice. The multi-duct tubes advantageously have a flow cross-section, which is constant throughout along the duct tube longitudinal axis, in order to allow a complete flow-through along the duct tube longitudinal axis. The multi-duct tubes are advantageously made of a material, which promotes a transfer of thermal energy from the first fluid to the second fluid, or vice versa, for example a heat-conductive plastic or a heat-conductive metallic material. As a whole, the multi-duct tubes, the fluid collector, and the multiphase distributor are fixed to one another. It is conceivable that the multi-duct tubes are soldered or welded to the multiphase distributor and to the fluid collector. A second flow path for a second fluid may furthermore lead through the multi-duct tubes, the fluid collector, and the multiphase distributor. The second fluid may be, for example, a coolant fluid, preferably water or glycol. The multi-duct tubes furthermore extend through the first flow path for the first fluid. This has the advantageous effect that the first fluid can flow around, for example in a perpendicular manner, and the second fluid can flow through the multi-duct tubes, for example in a hermetically sealed manner, respectively. This allows the function of a heat exchanger, namely the fluidically separate coupling of the first from the second fluid, and the transfer of thermal energy from the first fluid to the second fluid, or vice versa.

The fluid collector is arranged in the second flow path in such a way that, as part of a heating operation of the heat exchanger, in response to which heat is transferred from the second fluid to the first fluid, it is located downstream from the multiphase distributor. The second fluid can thus flow through the multiphase distributor, then through the multi-duct tubes, and then through the fluid collector. It is also safe to say that the fluid collector of the heat exchanger is arranged in the second flow path downstream, thus after the multiphase distributor. This has the effect that the first fluid absorbs thermal energy from the second fluid as part of the heating operation, so that the first fluid heats up. This furthermore has the effect that a pressure loss in the second fluid, which is caused, for example, by the constriction of the first flow path, may be slightly reduced in the heat exchanger, wherein a relatively large operating temperature range for the heat exchanger can be realized. The heat exchanger is thus advantageously able to operate for longer periods of time than previously, before an icing occurs. The energy efficiency can thus be improved.

As part of the heating operation of the heat exchanger, thermal energy can be transferred from the second fluid to the first fluid, experts thereby also refer to this as the "heating mode" or "heating operation" of the heat exchanger. The heating operation has the effect that the first fluid heats up. The heating operation of the heat exchanger may be realized by an "upward flow design" of the second fluid, wherein the first and second fluid basically flow from the bottom to the top through the heat exchanger, for example both opposite to the direction of gravity. "Upward flow design" may also mean that the first fluid and the second fluid flow parallel or virtually parallel to one another through the heat exchanger.

The heat exchanger preferred to be used in a heat exchanger system having at least two single heat exchangers, by way of example, each of them operating in a specific mode. By the nature of the heat exchanger system and depending on mode the single heat exchangers needs to work as either an evaporator or as a condenser, wherein a heating mode single heat exchangers is typically located outdoors and/or a cooling mode single heat exchangers is typically located indoors. For example, the indoor single heat exchanger is always working as the "opposite" single heat exchanger, e.g. when the outdoor single heat exchanger acts as an evaporator the indoor single heat exchanger works as a condenser. Thus the heat exchanger system is configured to selectively reject heat or to warm the space "indoor".

Moreover, for example, the fluid collector and the multiphase distributor may be contained inside their respective manifolds. They are preferred not to be stand-alone devices, which could contain refrigerant without being in a manifold. So both devices can help to control the distribution or refrigerant path.

For example, fluid can flow hermetically sealed inside the first flow path and inside the second flow path, for example including within the "multi-duct tubes", also called multi-port or multi-channel.

The fluid collector can also be arranged in the second flow path in such a way that, as part of a cooling operation of the heat exchanger, in response to which heat is transferred from the first fluid to the second fluid, it is located upstream of the multiphase distributor, so that the second fluid flows through the fluid collector, then through the multi-duct tubes, and then through the multiphase distributor.

As part of the cooling operation of the heat exchanger, thermal energy can be transferred from the first fluid to the second fluid, experts thereby also refer to this as the "cooling mode" or "cooling operation" of the heat exchanger. The cooling operation has the effect that the first fluid cools down. The cooling operation of the heat exchanger can advantageously be realized by a "downward flow design" of the second fluid, wherein the second fluid basically flows from the top to the bottom through the heat exchanger, thus in reverse to the "upward flow design", for example in the direction of gravity. "Downward flow design" may also mean that the first fluid and the second fluid flow anti-parallel or virtually anti-parallel to one another through the heat exchanger.

It should thus be noted that, as a function of the selected operating state of the heat exchanger, the second fluid may flow through the heat exchanger in different directions along the second flow path, namely advantageously either from the bottom to the top, thus in opposite direction of the direction of gravity, or from the top to the bottom, thus in the direction of the direction of gravity.

The fluid collector may advantageously have a cylindrical base body with a hollow interior for guiding the second fluid, for example a square body or a tubular body. The tubular body may have a tubular-body longitudinal axis and at least two opening arrangements, which each penetrate the tubular body transversely to the tubular-body longitudinal axis, of individual openings, which are arranged spaced apart from one another along the tubular-body longitudinal axis. An opening arrangement can also be described as "phase". The square body may also have a square-body longitudinal axis and at least two opening arrangements, which each penetrate the square body transversely to the square-body longitudinal axis, each opening arrangement formed of a plurality of individual openings, which are arranged spaced apart from one another along the square-body longitudinal axis. The second flow path for the second fluid may advantageously lead through the individual openings of the opening arrangements. The individual openings of the opening arrangements advantageously each form a nozzle, which basically place the second fluid into the multi-duct tubes in the manner of an evaporator. In the alternative, second fluid from the multi-duct tubes can flow into the fluid collector through the individual openings. A fluid collector equipped with the described opening arrangements provides the effect that the second fluid flowing through it can flow from the fluid collector into the multi-duct tubes or from the multi-duct tubes into the fluid collector particularly evenly and so as to be beneficial for flow. This has the advantage that, for example due to a reduction of the flow resistance, the energy efficiency of the heat exchanger is improved. The individual openings may be formed by individual bores.

With respect to the tubular-body longitudinal axis, the tubular body may furthermore advantageously have a tubular-body cross-section, which is constant throughout or which is variable along the tubular-body longitudinal axis. The tubular-body cross-section may be designed, for example, in a c-shaped or v-shaped manner.

The tubular body may advantageously have exactly two opening arrangements, thus two phases. The individual openings of a first opening arrangement may thereby be arranged spaced apart from one another along the tubular-body longitudinal axis by a first distance. The first distances can thereby be measured from center of the opening to center of the opening. A center of the opening may be formed or defined by the respective geometric center of an individual opening. The individual openings of a second opening arrangement may be arranged spaced apart from one another along the tubular-body longitudinal axis, each by forming a second distance. The second distances can thereby be measured from center of the opening to center of the opening. A center of the opening may also be formed or defined here by the respective geometric center of an individual opening. To be able to further improve the flow-through of the heat exchanger, the first distances of the individual openings of the first opening arrangement may be designed to be smaller than the second distances of the individual openings of the second opening arrangement. It is also conceivable that the first distances of the individual openings of the first opening arrangement are 54 mm (+/−5 mm) relative to one another, and that the second distances of the individual openings of the second opening arrangement are 108 mm (+/−10 mm) relative to one another. The individual openings of the first and second opening arrangement may thereby each have an opening diameter of 4.76 mm (+/−0.5 mm). In the alternative, the individual openings of the first opening arrangement may each have an opening diameter of 4.76 mm (+/−0.5 mm), and the individual openings of the second opening arrangement may have opening diameters, which are dimensioned with a size of 4.76 mm (+/−0.5 mm) and 6.35 mm (+/−0.6 mm), so as to alternate along the tubular-body longitudinal axis.

It may be provided that the individual openings of the first opening arrangement each have a first opening cross-section, and that the individual openings of the second opening arrangement each have a second opening cross-section. It may also be provided thereby that at least one or a plurality or all first opening cross-sections are smaller than the second opening cross-sections in terms of surface area. It is also conceivable that all first opening cross-sections are designed half as large as the second opening cross-sections in terms of surface area. This has the advantageous effect that the first opening arrangement, viewed in total, has a smaller opening cross-section, which is open to flow, than the second opening arrangement, in terms of surface area. For example, a larger fluid volume flow and/or fluid mass flow can thus flow through the second opening arrangement than through the first opening arrangement.

The duct tube longitudinal axes of the multi-duct tubes may furthermore each be aligned transversely or orthogonally with respect to the tubular-body longitudinal axis of the tubular body of the fluid collector. An angular or rectangular heat exchanger may thus be provided, which simplifies, for example, the assembly thereof.

It is further conceivable that the multiphase distributor has a cylindrical distributor tubular body with a hollow interior for guiding the second fluid or a distributor square body for guiding the second fluid. The distributor tubular body may define a distributor tubular-body longitudinal axis and may have at least one distributor opening arrangement, which penetrates the distributor tubular body transversely to the distributor tubular-body longitudinal axis, each opening arrangement formed of a plurality of distributor individual openings, which are arranged spaced apart from one another in the direction of the distributor tubular-body longitudinal axis. Each of the individual openings may expediently have an opening diameter of 1 mm. Fluid, for example the second fluid, can flow through the individual openings of the multiphase distributor, preferably from the multiphase distributor to the multi-duct tubes or, in the alternative, from the multi-duct tubes to the multiphase distributor.

The duct tube longitudinal axes of the multi-duct tubes may respectively be aligned transversely or orthogonally with respect to the distributor tubular-body longitudinal axis of the distributor tubular body of the multiphase distributor. An angular or rectangular heat exchanger may thus also be provided, which simplifies, for example, the assembly thereof.

The heat exchanger may have a fan, which is arranged in the first flow path, for driving the first fluid, for example air or ambient air, along the first flow path.

The heat exchanger may have a fluid pump, which is arranged in the second flow path, for driving the second fluid along the second flow path.

The multiphase distributor and the fluid collector or, in the alternative, the multiphase distributor or the fluid collector may advantageously be accommodated completely in a support tube. The support tube completely encloses the multiphase distributor and the fluid collector all around, so that fluid, for example the second fluid, can flow into or out of the respective support tube only through a support tube fluid connection of the respective support tube, so as to thus get to the multiphase distributor or to the fluid collector. The support tubes furthermore have passages for the multi-duct tubes, which are arranged at the multiphase distributor and fluid collector. The multi-duct tubes may be inserted, for example, through the passages of the support tubes and may lead into the multiphase distributor and the fluid collector. The multi-duct tubes may expediently be fixed by a material bond to the support tubes via soldering or welding.

The support tube fluid connections may be designed in such a way that a respective releasable supply hose can be arranged on them. This has the advantage that the heat exchanger can be fluidically connected to further components of a heat exchanger system, for example a fluid pump. The support tube fluid connections may either form a fluid inlet or a fluid outlet, depending on the flow direction of the second fluid along the second flow path.

It is furthermore conceivable to join two of the described heat exchangers to form a heat exchanger system. In addition to the two heat exchangers, the heat exchanger system may have a wedge-shaped housing, in which the two heat exchangers are arranged in a stationary manner and tilted at an angle to one another. It has been recognized that it is advantageous, when the heat exchangers are arranged in a v-shaped manner to one another. In any event, the heat exchanger system has at least one fan, which is arranged on the housing, for driving the first fluid, for example air or ambient air, and a fluid pump for driving the second fluid, so that the heat exchanger system can be operated for heating as part of a heating mode or for cooling as part of a cooling mode by the heat exchangers.

In summary, the invention may relate to a heat exchanger for coupling a first fluid to a second fluid so as to transfer heat. The heat exchanger may thereby have a fluid collector for receiving fluid, a multiphase distributor for distributing fluid, a first flow path for the first fluid, and a plurality of multi-duct tubes, which each have a duct tube longitudinal axis. The multi-duct tubes respectively lead into the multiphase distributor orifice and into the fluid collector by forming an orifice, wherein a second flow path for the second fluid extends respectively through the multi-duct tubes, the fluid collector, and the multiphase distributor. The multi-duct tubes thereby extend through the first flow path for the first fluid, so that the first fluid can flow around and the second fluid can flow through the multi-duct tubes, respectively. The multiphase distributor is arranged in the second flow path upstream of the fluid collector.

Further important features and advantages of the invention emerge from the dependent claims, from the drawings and from the associated description of the figures with reference to the drawings.

The features mentioned above and those which have yet to be explained below can be used not only in the respectively stated combination, but also in different combinations or on their own without departing from the scope of the present invention.

Preferred exemplary embodiments of the invention are illustrated in the drawings and are explained in more detail in the description below, wherein the same reference signs refer to identical or similar or functionally identical components.

In the following, preferred embodiments of the invention are described using the drawing.

DETAILED DESCRIPTION OF THE DRAWINGS

Figure 1:
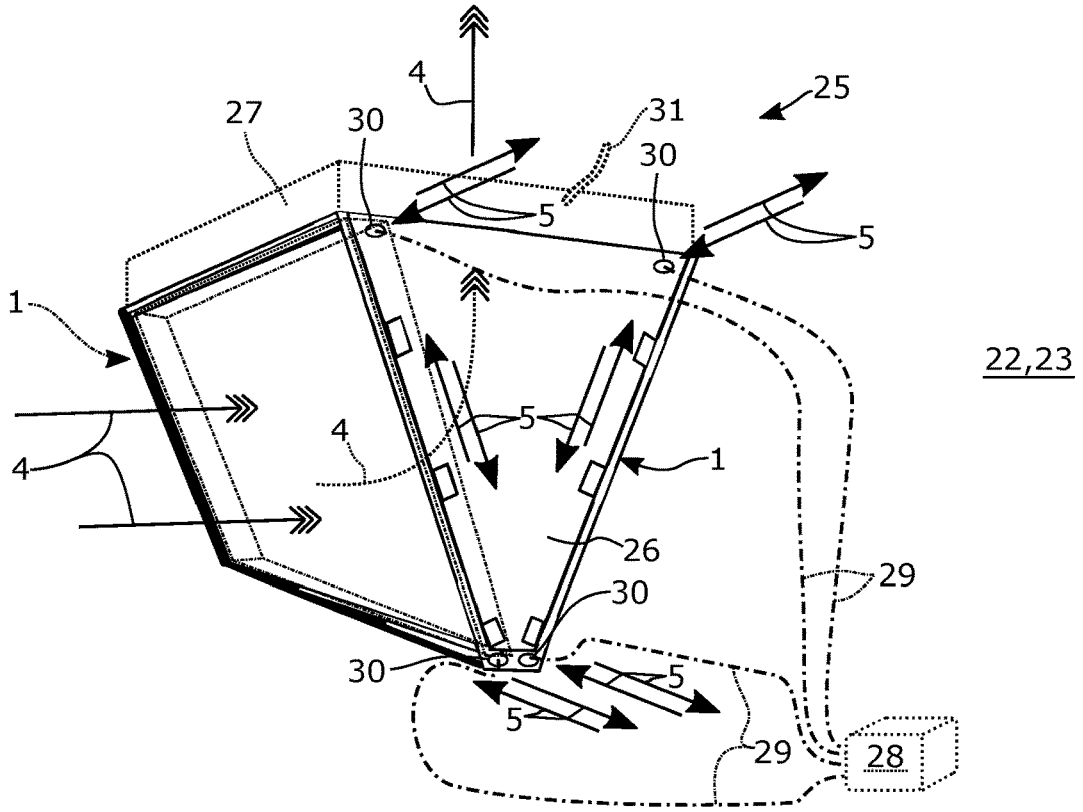
FIG. 1 shows a perspective view of a preferred exemplary embodiment of a heat exchanger system.

As a whole, the figures show a preferred exemplary embodiment of a heat exchanger, which is labeled with reference numeral 1, of which two pieces are integrated in an exemplary manner in a preferred exemplary embodiment of a v-shaped heat exchanger system 25, which is illustrated in FIG. 1. As does the heat exchanger system 25, a heat exchanger 1 serves to transfer thermal energy from the first fluid to the second fluid or vice versa via the heat-transferring, fluidically separate coupling of a first fluid to a second fluid. Depending on whether thermal energy is transferred from the first fluid to the second fluid or from the second fluid to the first fluid, one refers to a cooling operation 23 of the heat exchanger 1 or to a heating operation 22 of the heat exchanger 1. The heat exchanger system 25 can analogously also be operated for heating as part of a heating mode or for cooling as part of a cooling mode. Heat exchangers 1 or heat exchanger systems 25 are usually used in air conditioning systems. As part of the heating mode for heating the heat exchanger system 25, the heat exchangers 1 are switched into the heating operation 22, wherein they are operated in an "upward flow design". This means that the first fluid and the second fluid basically flow through the respective heat exchanger 1 from the bottom to the top, thus in the opposite direction of or at an angle to the direction of gravity. In any event, thermal energy is transferred from the second fluid to the first fluid as part of the heating operation 22 of the heat exchanger 1, so that a building, for example, can be air-conditioned/heated. As part of the cooling mode for cooling the heat exchanger system 25, the heat exchangers 1 are switched into the cooling operation 23, wherein they are operated in a "downward flow design". This means that the second fluid basically flows through the heat exchanger 1 from the top to the bottom, thus in the direction of or at an angle to the direction of gravity, thus in reverse to the "upward flow design".

It is thus important to note that the second fluid can flow through the heat exchanger 1 in different directions along a second flow path 5 as a function of the selected operating state 22, 23 of the heat exchanger 1. To illustrate this, arrows, which are directed from the top to the bottom, and arrows, which are directed from the top to the bottom and from the bottom to the top, respectively labeled with reference numeral 5, are incorporated in FIG. 1. They each specify the flow direction of the second fluid along the flow path 5.

FIG. 1 shows a perspective view of the preferred exemplary embodiment of the heat exchanger system 25, illustrating that the heat exchanger system 25 has a wedge-shaped housing 26, in which two heat exchangers 1 are arranged on the housing 26 in a stationary manner and tilted at an angle to one another in a v-shaped manner. The heat exchanger system 25 furthermore has a fan 27, which is arranged at the top end of the housing 26, for driving the first fluid along a first flow path 4, which is indicated by double arrows in FIG. 1 and which extends through the housing 26 in the opposite direction of the direction of gravity in an exemplary manner. The fan 27 may be electrically operated in an exemplary manner, for the purpose of which an electrical plug-in contact 31 is provided in an exemplary manner. The first fluid is, for example, air or ambient air.

The heat exchanger system 25 furthermore has a fluid pump 28, which is indicated by a dashed box in FIG. 1, for driving the second fluid along the described flow path 5. The fluid pump 28 may be fluidically coupled to the heat exchanger 1 via supply hoses 29 and support tube fluid connections 30, which are indicated by a dot-dash line. As a function of the selected operating mode of the heat exchanger system 25 or as a function of whether the heat exchanger 1 operates in the cooling operation 23 or in the heating operation 22, the second fluid can flow through each heat exchanger 1 via the fluid pump 28 in the direction of the direction of gravity along the flow path 5, basically from the top to the bottom or vice versa, in the opposite direction of the direction of gravity basically from the bottom to the top through the heat exchanger 1. Depending on the present flow direction of the second fluid, the support tube fluid connections 30 can selectively either form a fluid inlet or a fluid outlet. The fluid pump 28 can supply a fluid inlet as well as a fluid outlet in an exemplary manner.

Figure 2:
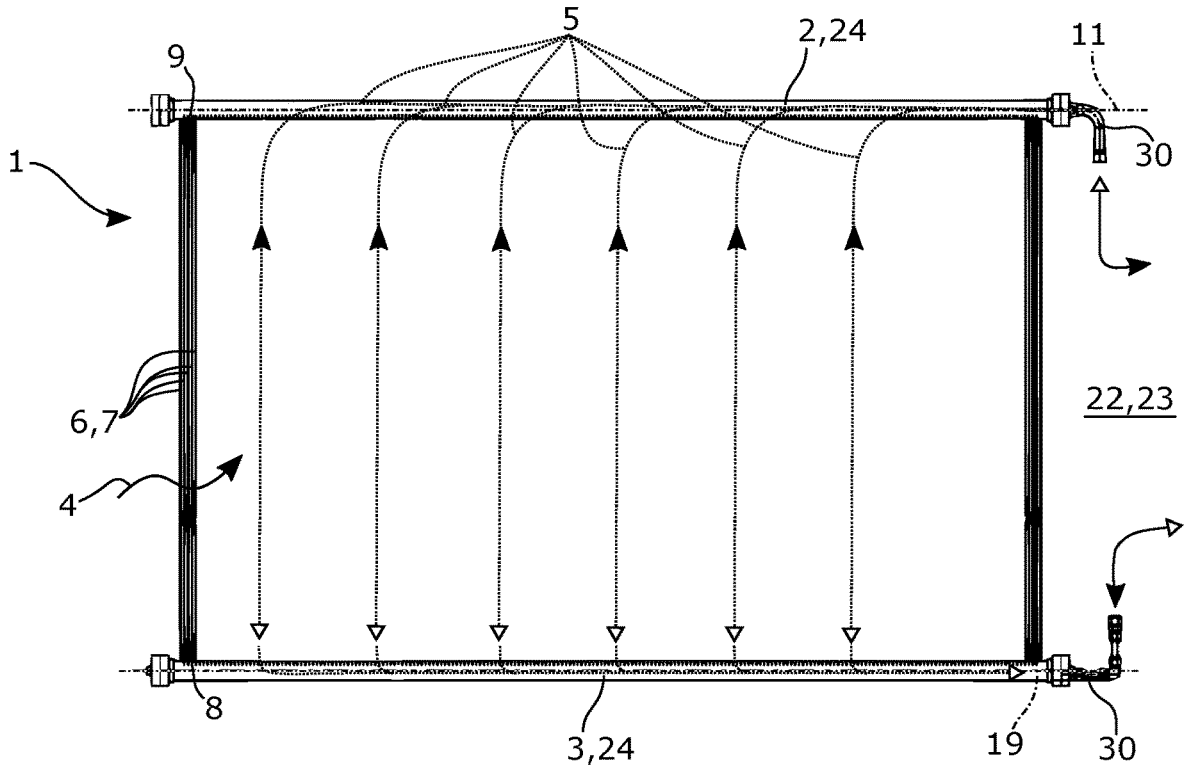
FIG. 2 shows a preferred exemplary embodiment of a heat exchanger arranged in the heat exchanger system according to FIG. 1, in a top view.

In a top view, FIG. 2 shows a preferred exemplary embodiment of a heat exchanger 1, which is arranged in the heat exchanger system 25 according to FIG. 1. The heat exchanger 1 has a fluid collector 2, which is arranged completely inside the support tube 24, for collecting the second fluid, and a multiphase distributor 3, which is also arranged completely inside a support tube 24, for distributing the second fluid. The heat exchanger 1 furthermore has a plurality of multi-duct tubes 6, which each have a duct tube longitudinal axis 7 and which are reach inserted through a radial passage of the support tubes 24, and which, by forming a distributor orifice 8 lead into the multiphase distributor 3 on the one hand, and, by forming a collector orifice 9, lead into the fluid collector 2 on the other hand. Only some multi-duct tubes 6 are indicated in FIG. 2, so that the second flow path 5 of the second fluid can be seen, illustrated here by a plurality of dotted lines. The multi-duct tubes 6 may expediently be fixed via a material bond to the support tubes 24 by soldering or welding. The support tubes 24 completely encloses the multiphase distributor 3 and the fluid collector 2 all around, so that each support tube 24 has one of the above-mentioned support tube fluid connections 30, so as to be able to guide second fluid through the heat exchanger 1.

It can also be seen in FIG. 2 that the duct tube longitudinal axes 7 of the multi-duct tubes 6 are respectively aligned orthogonally with respect to a distributor tubular-body longitudinal axis 19 of the multiphase distributor 3 and orthogonally with respect to a tubular-body longitudinal axis 11 of the fluid collector 2. It is further illustrated in FIG. 2 that the second flow path 5 leads through the multi-duct tubes 6, the fluid collector 2, and the multiphase distributor 3. A first flow path 4 for the first fluid is only illustrated at one point by an arrow, which is designed in a curved manner, but it can nonetheless be seen that the multi-duct tubes 6 basically extend through the first flow path 4 for the first fluid. As a result, the first fluid can thus flow around and the second fluid can flow through the multi-duct tubes 6, respectively.

It can furthermore be seen in FIG. 2 that, when the heat exchanger 1 is operated in the heating operation 22, the fluid collector 2 is arranged in the second flow path 5 in such a way that it is located downstream from the multiphase distributor 3, and that the second fluid flows through the multiphase distributor 3, then through the multi-duct tubes 6, and then through the fluid collector 2, as indicated by corresponding full arrows of the second flow path 5.

It is additionally incorporated in FIG. 2 that, when the heat exchanger 1 is operated in the cooling operation 23, the fluid collector 2 may be arranged in the second flow path 5 in such a way that it is located upstream of the multiphase distributor 3 and that the second fluid then initially flows through the fluid collector 2, then through the multi-duct tubes 6, and then through the multiphase distributor 3, which is indicated in FIG. 2 by half-full arrows of the flow path 5.

Figure 3:
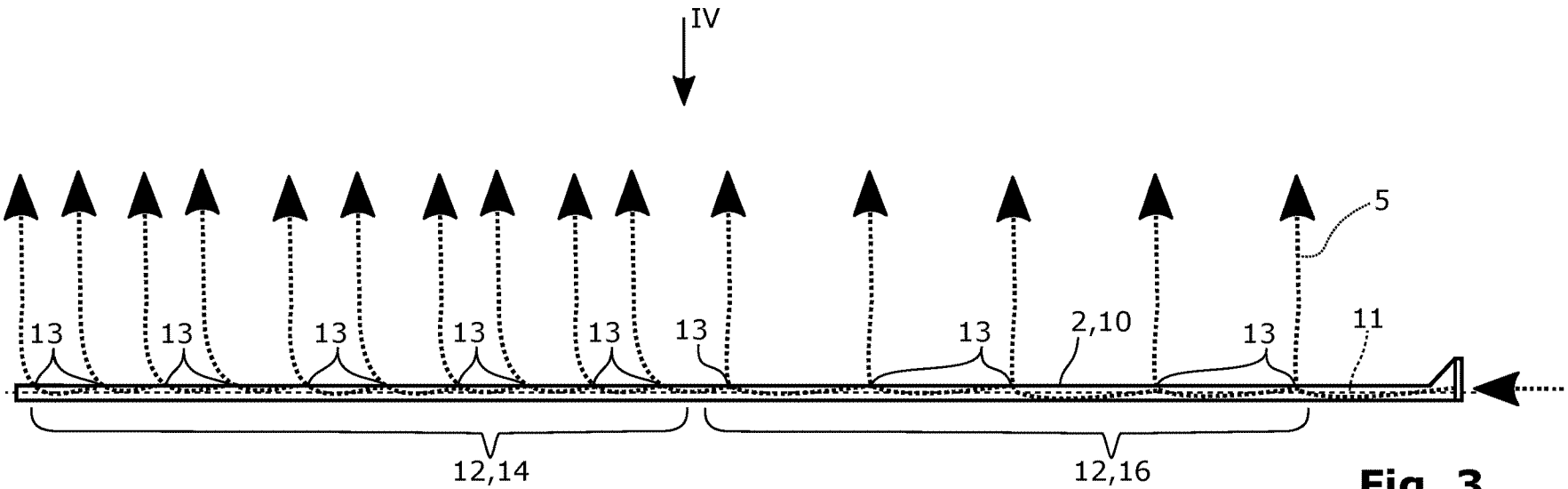
FIG. 3 shows a fluid collector of the heat exchanger from FIG. 2 in a side view, with a support tube, a multiphase distributor, and multi-duct tubes omitted for simplicity.

In FIG. 3, the fluid collector 2 of the heat exchanger 1 from FIG. 2 can be seen in a side view, but the encasing support tube 24, the multiphase distributor 3, and the multi-duct tubes 6 are hidden in favor of better visibility of the fluid collector 2. It can be seen well that the fluid collector 2 has a cylindrical tubular body 10 for guiding the second fluid. The tubular body 10 defines a tubular-body longitudinal axis 11, which is indicated by dashes in FIG. 3, and at least two opening arrangements 12, which each penetrate the tubular body 10 transversely to the tubular-body longitudinal axis 11. The opening arrangements 12 each have a plurality of individual openings 13, which are arranged spaced apart from one another along the tubular-body longitudinal axis 11 and which each completely penetrate the tubular body 10. The tubular body 10 may expediently have a tubular-body cross-section, which is constant throughout, with respect to the tubular-body longitudinal axis 11. In addition, the second flow path 5 is indicated in a dotted manner in FIG. 3.

Figure 4:
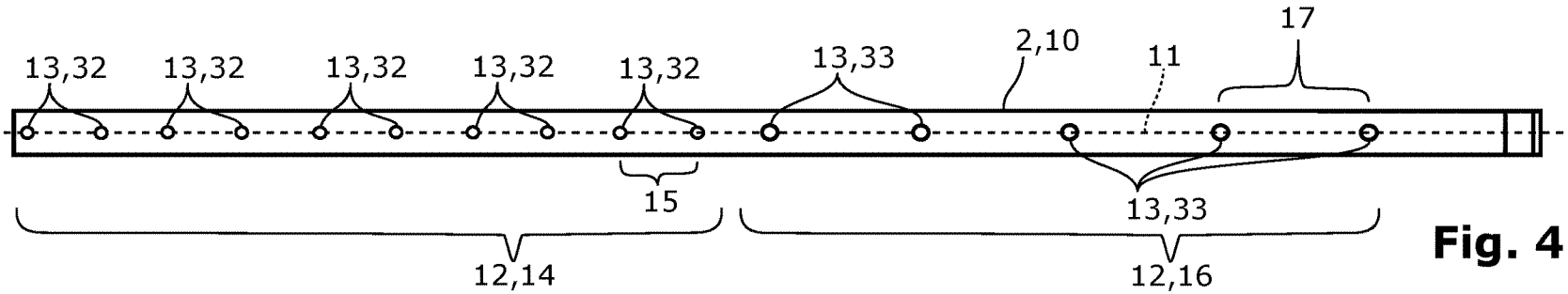
FIG. 4 shows the fluid collector of the heat exchanger from FIG. 3 in a top view according to an arrow IV incorporated therein.

To be able to better see and describe the individual openings 13 of the two opening arrangements 12, FIG. 4 shows a top view of the fluid collector 2 in the viewing direction of an arrow IV, which is incorporated in FIG. 3. It can be seen that the tubular body 10 has exactly two opening arrangements 12, 14, 16. The individual openings 13 of a first opening arrangement 12, 14 are spaced apart from one another along the tubular-body longitudinal axis 11 by a first distance 15, which is measured, for example, in millimeters, between center of the opening and center of the opening. The individual openings 13 of a second opening arrangement 12, 16 are spaced apart from one another along the tubular-body longitudinal axis 11 by a second distance 17, which is measured, for example, in millimeters, between center of the opening and center of the opening. The first distances 15 are thereby smaller than the second distances 17, the first distances 15 are respectively preferably 54 mm (+/−5 mm), and the second distances 17 are respectively 108 mm (+/−10 mm). The opening diameters of the first individual openings 13 of the first opening arrangement 12, 14 may be designed to be smaller than the opening diameters of the second individual openings 13 of the second opening arrangement 12, 16. In an exemplary embodiment, which is not illustrated here, the individual openings 13 of the first opening arrangement 12, 14 may also each have an opening diameter of 4.76 mm (+/−0.5 mm), while the individual openings 13 of the second opening arrangement 12, 16 have opening diameters, which alternate along the tubular-body longitudinal axis 11, namely 4.76 mm (+/−0.5 mm) and 6.35 mm (+/−0.6 mm).

It can also be seen in FIG. 4 that the individual openings 13 of the first opening arrangement 12, 14 each have a first opening cross-section 32, and that the individual openings 13 of the second opening arrangement 12, 16 each have a second opening cross-section 33. It is provided in an exemplary manner that at least one of the or a plurality of or all first opening cross-sections 32 are smaller than the second opening cross-sections 33 in terms of surface area. It is also conceivable that all first opening cross-sections 32 are designed to be half or a quarter as large as the second opening cross-sections 33 in terms of surface area.

Figure 5:
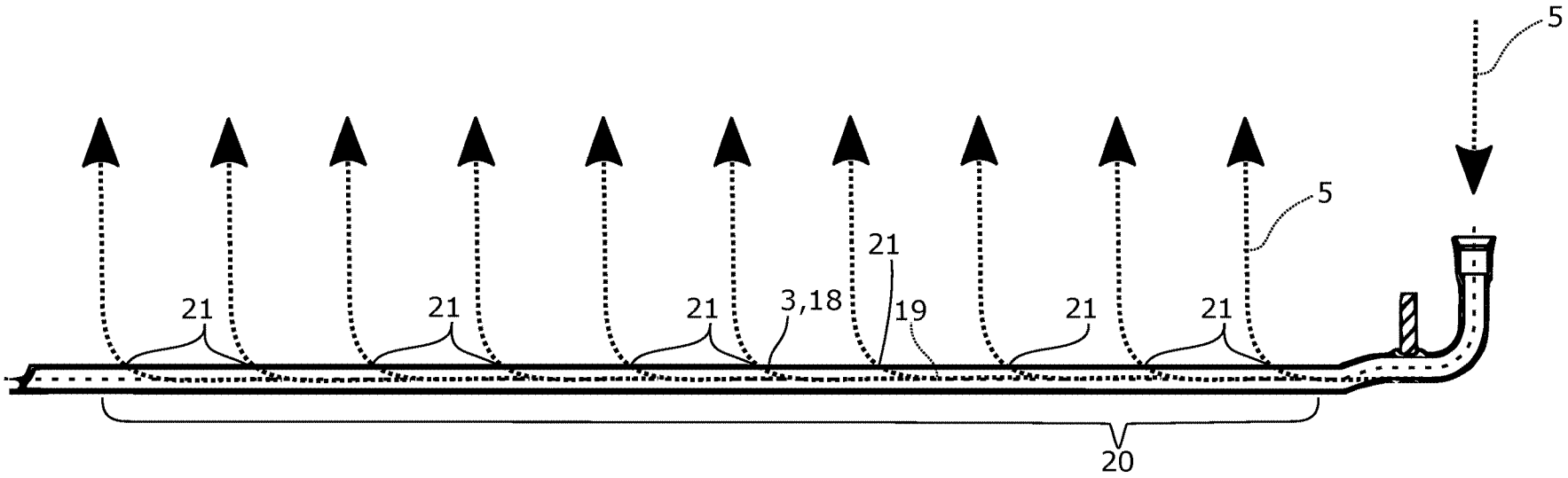
FIG. 5 shows a multiphase distributor of the heat exchanger from FIG. 2 in a side view, with a support tube, a fluid collector, and multi-duct tubes omitted for simplicity.

Lastly, FIG. 5 shows the multiphase distributor 3 of the heat exchanger 1 from FIG. 2 in a side view. The support tube 24, the fluid collector 2, and multi-duct tubes 6 are again hidden in factor of better visibility. It can be seen in FIG. 5 that the multiphase distributor 3 has a cylindrical distributor tubular body 18 for guiding the second fluid. The distributor tubular body 18 has a distributor tubular-body longitudinal axis 19 and at least one distributor opening arrangement 20, which penetrates the distributor tubular body 18 transversely to the distributor tubular-body longitudinal axis 19 and which consists of a plurality of distributor individual openings 21, which are arranged spaced apart from one another in the direction of the distributor tubular-body longitudinal axis 19. The distributor individual openings 21 each have an opening diameter, for example 4.76 mm. In addition, the second flow path 5 is indicated in a dotted manner in FIG. 5.

While the above description constitutes the preferred embodiments of the present invention, the invention is susceptible to modification, variation and change without departing from the proper scope and fair meaning of the accompanying claims.

What is claimed is:

1. A heat exchanger for coupling a first fluid to a second fluid so as to transfer heat in a fluidically separate manner, the heat exchanger comprising:

a fluid collector (2) for collecting fluid, a multiphase distributor (3) for distributing fluid, a first flow path (4) for the first fluid, a plurality of multi-duct tubes (6), which each have a duct tube longitudinal axis (7) and which each lead into the multiphase distributor (3) via a distributor orifice (8) and into the fluid collector (2) via a collector orifice (9), wherein a second flow path (5) for the second fluid extends through the multi-duct tubes (6), the fluid collector (2), and the multiphase distributor (3), wherein the multi-duct tubes (6) extend through the first flow path (4) for the first fluid in a configuration to allow the first fluid to flow around the multi-duct tubes and to allow the second fluid to flow, in a hermetically sealed manner, through the multi-duct tubes (6), respectively;

wherein the fluid collector (2) has a cylindrical tubular body (10) located therein with a hollow interior for guiding the second fluid, wherein the tubular body (10) has a tubular-body longitudinal axis (11) and exactly two opening arrangements (12, 14, 16) forming a plurality of individual openings (13) penetrating the tubular body (10) transversely to the tubular-body longitudinal axis (11) and spaced apart from one another along the tubular-body longitudinal axis (11);

wherein the two opening arrangements (12, 14, 16) are a first opening arrangement (12, 14) and a second opening arrangement (12, 16), wherein the individual openings (13) of the first opening arrangement (12, 14) are spaced apart from one another along the tubular-body longitudinal axis (11) by a first distance (15) measured from centers of adjacent ones of the individual openings of the first opening arrangement, wherein the individual openings (13) of the second opening arrangement (12, 16) are spaced apart from one another along the tubular-body longitudinal axis (11), by a second distance (17), measured from centers of adjacent ones of the individual openings of the second opening arrangement, wherein the first distance (15) of the individual openings (13) of the first opening arrangement (12, 14) is smaller than the second distance (17) of the individual openings (13) of the second opening arrangement (12, 16);

wherein each of the individual openings (13) of the first opening arrangement (12, 14) has a first opening cross-section (32), wherein each of the individual openings (13) of the second opening arrangement (12, 16) has a second opening cross-section (33), the first opening cross-section (32) being smaller than the second opening cross-section (33); and wherein, in the course of a heating operation (22) of the heat exchanger (1), during which heat is transferred from the second fluid to the first fluid, the fluid collector (2) is arranged in the second flow path (5) downstream from the multiphase distributor (3), and the heat exchanger is configured to pass the second fluid first through the multiphase distributor (3), then through the multi-duct tubes (6), and then through the fluid collector (2).

2. The heat exchanger according to claim 1, wherein, in the course of a cooling operation (23) of the heat exchanger (1), during which heat is transferred from the first fluid to the second fluid, the fluid collector (2) is arranged in the second flow path (5) upstream of the multiphase distributor (3), and the heat exchanger is configured to pass the second fluid first through the fluid collector (2), then through the multi-duct tubes (6), and then through the multiphase distributor (3).

3. The heat exchanger according to claim 1, wherein the tubular body (10) has a tubular-body cross-section which is c-shaped.

4. The heat exchanger according to claim 1, wherein the first distance (15) is half as long as the second distance (17).

5. The heat exchanger according to claim 1, wherein the first distance (15) of the individual openings (13) of the first opening arrangement (12, 14) is between 49 mm and 59 mm, and wherein the second distance (17) of the individual openings (13) of the second opening arrangement (12, 16) is between 98 mm and 118 mm.

6. The heat exchanger according to claim 1, wherein the first cross-section defines a first opening area and the second cross-section defines a second opening area, the second opening area being twice as large as the first opening area.

7. The heat exchanger according to claim 1, wherein the individual openings (13) of the first opening arrangement (12, 14) each have an opening diameter between 4.26 mm and 5.26 mm, and wherein the individual openings (13) of the second opening arrangement (12, 16) have opening diameters alternating between a first diameter of 4.26 mm to 5.26 mm and a second diameter of 5.75 mm to 6.95 mm, which alternate along the tubular-body longitudinal axis (11).

8. The heat exchanger according to claim 1, wherein the duct tube longitudinal axes (7) of the multi-duct tubes (6) are aligned transverse to the tubular-body longitudinal axis (11) of the tubular body (10) of the fluid collector (2).

9. The heat exchanger according to claim 8, wherein the duct tube longitudinal axes (7) of the multi-duct tubes (6) are aligned transverse to the distributor tubular-body longitudinal axis (19) of the distributor tubular body (18) of the multiphase distributor (3).

* * * * *